US005976166A

United States Patent [19]

Nakajima

[11] Patent Number: 5,976,166

[45] Date of Patent: Nov. 2, 1999

[54] CLASPLESS STUD FOR PIERCING

[75] Inventor: Takeshi Nakajima, Tokyo, Japan

[73] Assignee: NAC Co., Ltd., Tokyo, Japan

[21] Appl. No.: 08/997,033

[22] Filed: Dec. 23, 1997

[30] Foreign Application Priority Data

Dec. 24, 1996 [JP] Japan ..... 8-355710
Dec. 3, 1997 [JP] Japan ..... 9-348675

[51] Int. Cl.[6] ..... A61B 17/34

[52] U.S. Cl. ..... 606/188; 63/12; 63/13; 63/14.2; 606/185; 606/186; 606/116; 606/117

[58] Field of Search ..... 606/188, 185, 606/186, 187, 189, 167, 117, 116; 63/12, 13, 14.2

[56] References Cited

U.S. PATENT DOCUMENTS

| | | | |
|---|---|---|---|
| Re. 35,511 | 5/1997 | Nakamura | 63/12 |
| 460,138 | 9/1891 | Hornberger | 606/188 |
| 4,694,781 | 9/1987 | Howe et al. | 606/185 |
| 5,496,343 | 3/1996 | Reil | 606/188 |
| 5,638,700 | 6/1997 | Shecter | 63/12 |
| 5,827,317 | 10/1998 | Hastings | 608/188 |
| 5,868,684 | 2/1999 | Akerfeldt et al. | 606/185 |

FOREIGN PATENT DOCUMENTS

| | | |
|---|---|---|
| 63-197412 | 12/1988 | Japan . |
| 3-48507 | 6/1991 | Japan . |

*Primary Examiner*—Michael Buiz
*Assistant Examiner*—(Jackie)Tan-Uyen T. Ho
*Attorney, Agent, or Firm*—Jacobson, Price, Holman & Stern, PLLC

[57] ABSTRACT

Objective of this Invention

The present invention provides a stud that is used to pierce an earlobe and that eliminates the need for a needle-like tip or a fixture such as a clasp following piercing.

Description of Claspless stud for piercing

A lock 12 that is larger than the diameter of the shaft 11 is formed at one end of the shaft 11. A sharp end piece 13 that is penetrated into the earlobe to form a through hole therein is formed at the tip of the lock 12 so that it can be detached from the shaft 11.

10 Claims, 5 Drawing Sheets

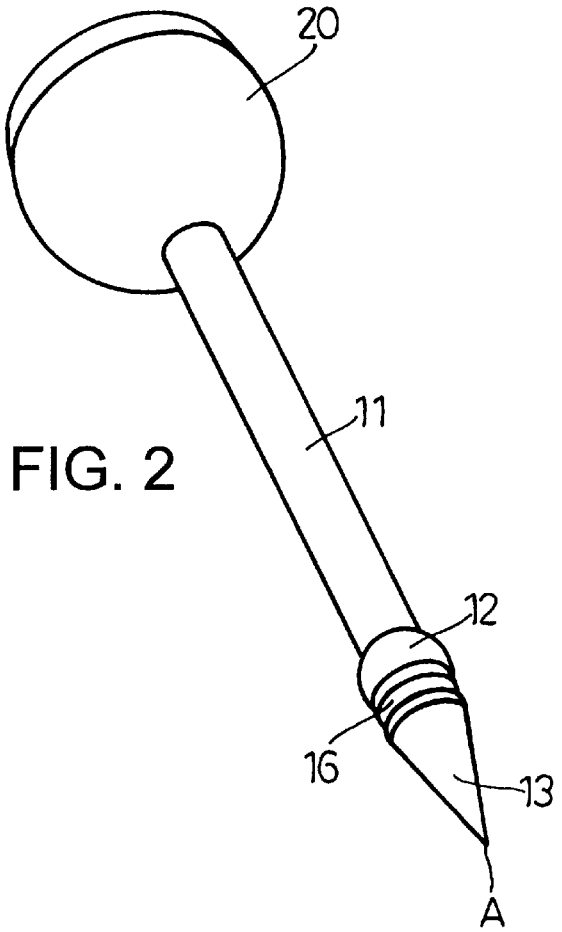
FIG. 2
FIG. 3(a)
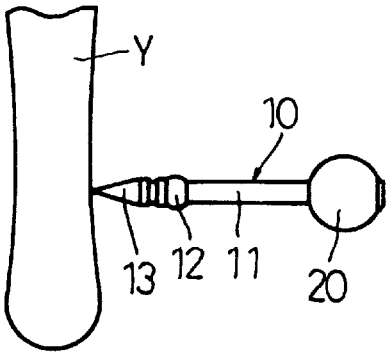
FIG. 3(b)
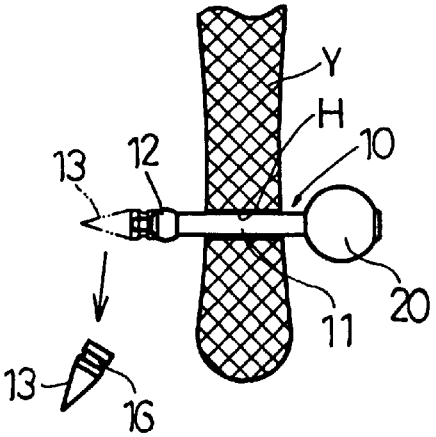

CLASPLESS STUD FOR PIERCING

DETAILED DESCRIPTION OF THE INVENTION

1. Field of the Invention

The present invention relates to a claspless stud for piercing that is worn by penetrating through an earlobe a shaft having a sharp point at one end and an ornament at the other end.

2. The Prior Art

Pierce-type earrings consist of a shaft that is attached to an earlobe, an ornament provided on the shaft, and a fixture that prevents the earring from slipping out from the earlobe. Among them, earrings for piercing have a shaft with a tip shaped like a sharp needle. Examples of conventional fixtures, which are called clasps or catches, are shown in FIG. 6 in Japanese Utility Model Laid Open No. 63-197412.

The fixture is used with almost all pierce-type earrings, but may obstruct the washing and sterilization that must be performed before a hole penetrating the earlobe is made, resulting in an insanitary condition. In addition, the fixture itself is obstructive and the needle tip for piercing may penetrate the cheek skin.

After the through hole in the earlobe has been completed, a sharp needle is unnecessary, so a pierce-type earring without a needle can then be used instead of the pierce-type earring for piercing. By way of example, a fixture for an earring disclosed in Japanese Utility Model Laid Open No. 3-48507 is shown. The needle-like tip, however, is essential to the earring for piercing, and all known earrings of this type require a member such as a clasp.

SUMMARY OF THE INVENTION

This invention is provided in view of these points, and its object is to enable piercing as with conventional earrings for piercing and to eliminate the need for the needle-like tip and a fixture such as a clasp following piercing.

It is another object of this invention to provide a claspless stud that acts as an earring, can be removed from the earlobe after the through hole has been made, and can later be reinstalled.

These and other objects have been attained by the claspless stud for piercing, which comprises a lock that is larger than the diameter of the shaft is formed at one end of the shaft, and a sharp end piece that is penetrated into the earlobe to form a through hole therein is formed at the tip of the lock so that it can be detached from the shaft.

BRIEF DESCRIPTION OF THE DRAWINGS

FIG. 1(*b*) is a vertical cross-sectional view showing a sharp end piece when detached from the claspless stud.

FIG. 2 is a perspective view of the stud.

FIG. 3(*a*) is a side view prior to penetration through an earlobe.

FIG. 3(*b*) is a side view after penetration through the earlobe.

FIG. 4(*b*) is a partial cross-sectional view showing the sharp end piece when attached to the shaft.

FIG. 5(*b*) is a vertical cross-sectional view of the shaft.

FIG. 5(*c*) is a side view showing a portion of the shaft.

FIG. 6(*b*) is a vertical cross-sectional view of the shaft.

FIG. 6(*c*) is a side view showing a portion of the shaft.

DETAILED DESCRIPTION OF THE PREFERRED EMBODIMENT

Figure 1A:
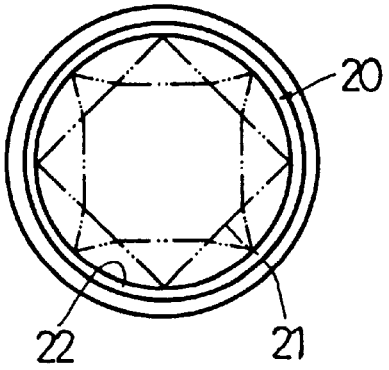
FIG. 1(*a*) is a plan view showing a first embodiment of a claspless stud for piercing according to this invention.

A claspless stud 10 according to this invention is for piercing and is used to form, in an earlobe without a hole, a through hole through which an earring is worn.

The stud is a shaft 11 having a sharp point A at one end and an ornament 20 at the other end. The shaft 11 is formed of a member shaped like a hollow pipe or a solid rod. The shaft 11 penetrates an earlobe Y. Thus, its length is larger than the thickness of the earlobe Y and its diameter is equal to the inner diameter of a through hole H after it is formed.

A lock 12 that is larger than the diameter of the shaft 11 is formed at one end of the shaft 11. The purpose of the lock 12 is to prevent the shaft 11 from slipping out of the through hole H following piercing. The lock 12, however, must also be able to pass through the through hole while enlarging it when the hole is healed after several weeks. Desirably, the lock 12 has a larger diameter than the diameter of the shaft 11 and is sized and formed so as to pass through the through hole H. The lock is required to pass through the through hole H when it is formed.

Thus, the illustrated lock 12 desirably has an external shape consisting of a spherical surface in order to reduce pain during insertion. According to the embodiment, good results were obtained when the diameter of the shaft 11 was 0.93 mm, while the maximum diameter of the lock 12 was 1.302 (140% of the diameter of the shaft 11) to 1.581 mm (170%). The lock 12 must be integrated with the shaft 11.

A sharp end piece 13 is formed at the sharp end of the lock 12, that is, one end of the shaft 11, so that it can be detached from the shaft 11. The sharp end piece 13 is penetrated into the earlobe Y to form the through hole H by stab wound therein. Thus, the sharp end piece 13 is formed so as to have a cross section tapered starting with a tip A and ending with a base enlarged substantially to the diameter of the lock 12.

To provide the detachable sharp end piece, for example, a fitting means with protrusions and recesses that can be attached to and detached from the shaft or a means that can no longer be integrated with the shaft once detached therefrom may be devised. Either of them may be used for this invention. The fitting means shown in FIGS. 1 and 2 consists of a protruding portion 14 and a recessed portion 15 that is detachably fitted to the protruding portion 14. The protruding portion 14 is provided on the shaft 11 and the recessed portion 15 is provided on the sharp end piece 13. In this case, the sharp end 17 of the protruding portion 14 should be formed in advance.

Figure 4A:
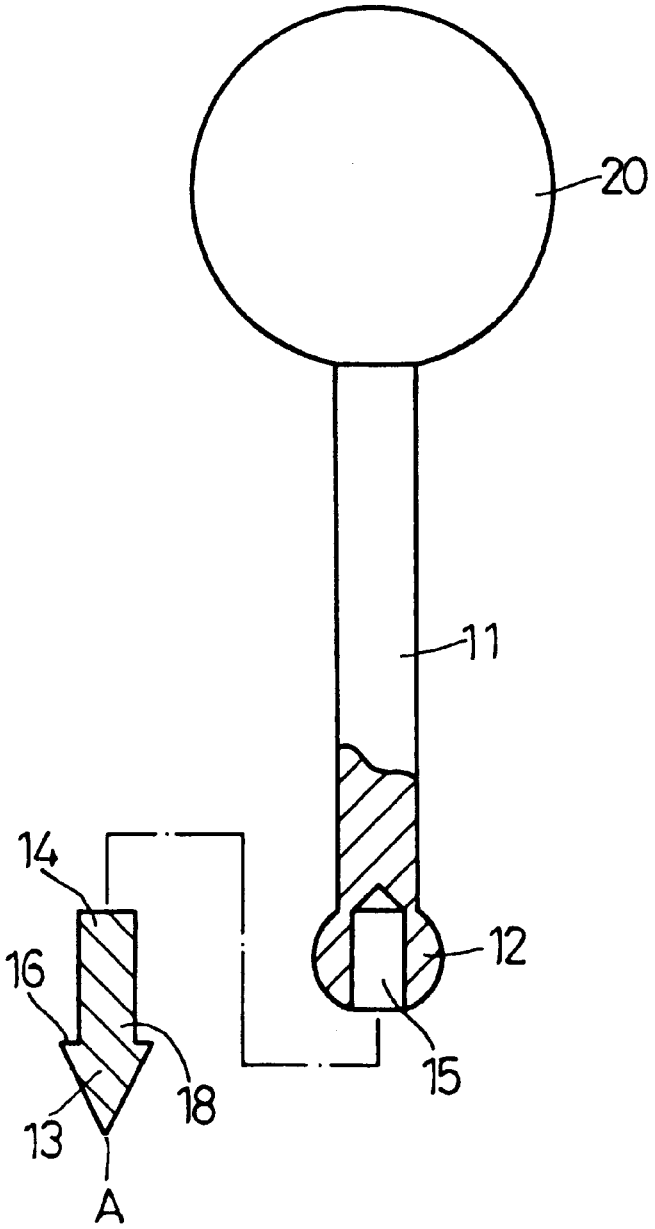
FIG. 4(*a*) is a partially exploded side view showing a second embodiment of the stud according to this invention.
Figure 4B:
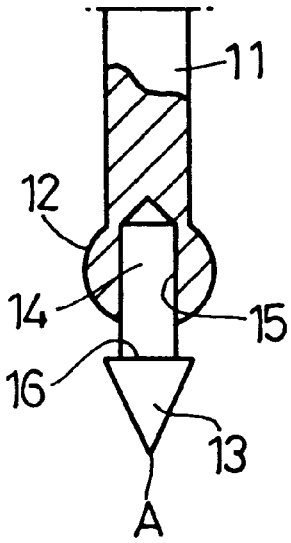

On the other hand, in the fitting means shown in FIGS. 4(*a*) and (*b*), the protruding portion 14 is provided at the proximal end of the sharp end piece 13 or the proximal end of the sharp end piece 13 is used as the protruding portion 14, and the recessed portion 15 extends from one end of the shaft 11 to the inside of the lock 12. In this example, the length of a shaft portion 18 in which the protruding portion 14 is formed may be greater than the depth of the recessed portion 15.

Figure 1B:
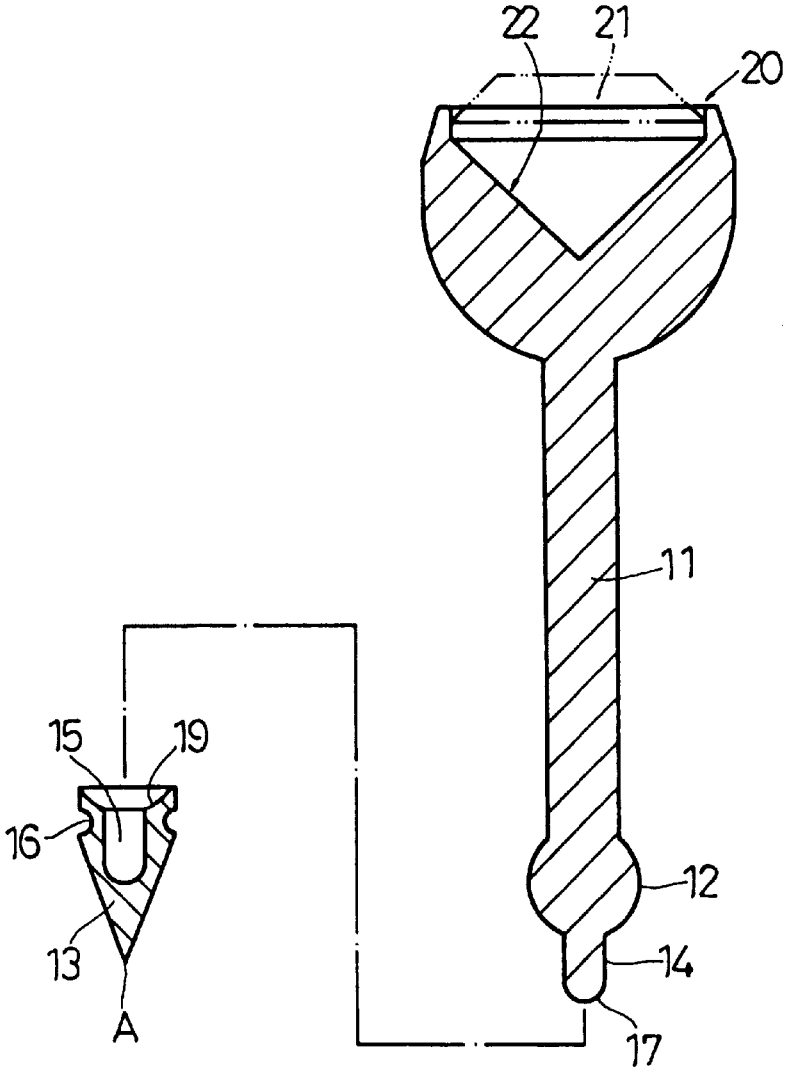

The sharp end piece 13 has a hook portion 16 that can be easily grasped using fingernails or a pair of tweezers in order to detach the piece from the shaft 11. In this case, by simply increasing the length of the shaft portion 18 of the sharp end piece 13 shaped like a downward arrow as shown in FIG. 4, the hook portion 16 can be used to allow fingernails to easily grasp the proximal end of the sharp end piece 13. In the example that is shown in FIGS. 1 and 2 and has an inner surface 19 that can be adhered to the spherical surface of the lock 12, a recessed portion is provided in the outer circumference of the base of the sharp end piece 13 as the hook portion 16.

Figure 5A:
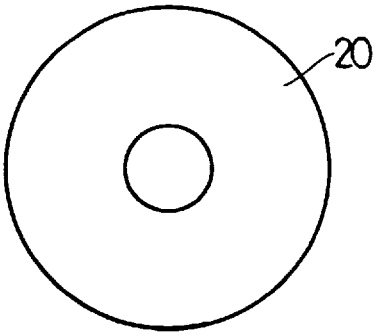
FIG. 5(*a*) is a plan view showing the shaft of a third embodiment of the stud according to this invention.
Figure 5C:
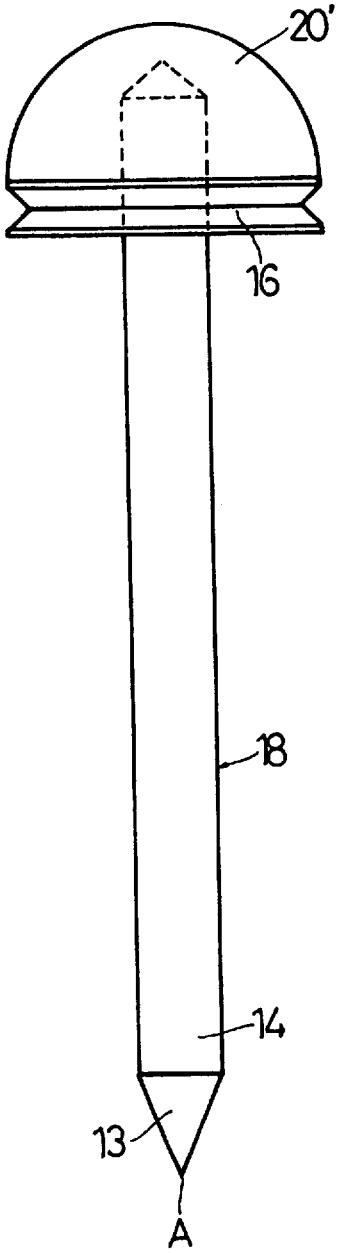
Figure 5B:
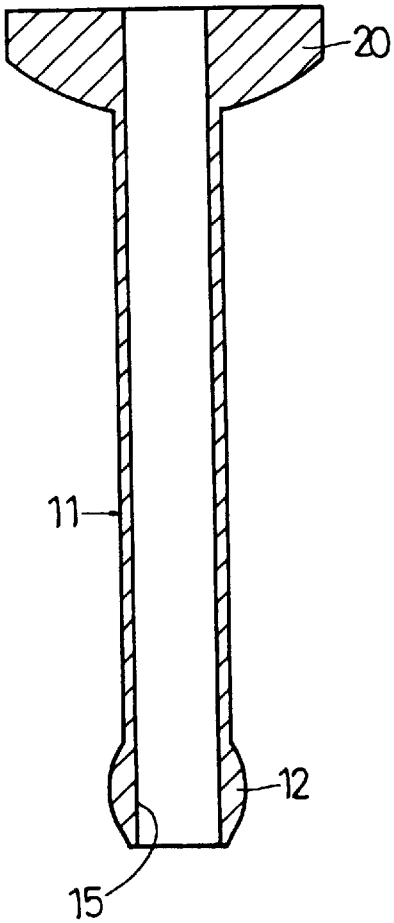

The fitting means shown in FIG. 5 and the subsequent figures is formed by further extending the shaft portion 18 of the sharp end piece 13 shaped like an arrow as shown in FIG. 4 and correspondingly extending the recessed portion 15 to the inside of the lock 12, and is common to the example shown in FIG. 4. The extension of the recessed portion 15 results in a pipe-shaped shaft 11, into which the shaft portion 18 can be inserted for integration. The shaft 11 can be formed of a member shaped like a hollow pipe, as described above.

In the example shown in FIGS. 5(*a*) to (*c*), a lock 12 having a diameter larger than the outer diameter of the pipe-shaped shaft 11 is provided at one end of the shaft 11, and the ornament 20 is provided at the other end. One end of the shaft portion 18 constitutes a sharp end piece 13, and the other end constitutes an ornament 20'. Thus, when the shaft portion 18 is inserted into the shaft 11, the sharp end piece 13 protrudes from the tip of the lock 12 and can be detached from the shaft 11. The shaft 11 in this example is generally integrally formed by means of machining.

Figure 6A:
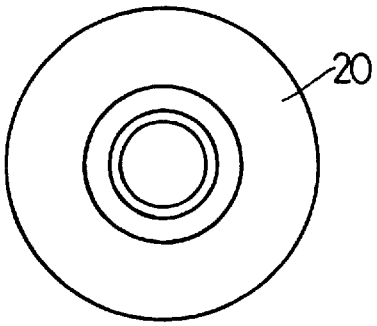
FIG. 6(*a*) is a plan view showing the shaft of a fourth embodiment of the stud according to this invention.
Figure 6B:
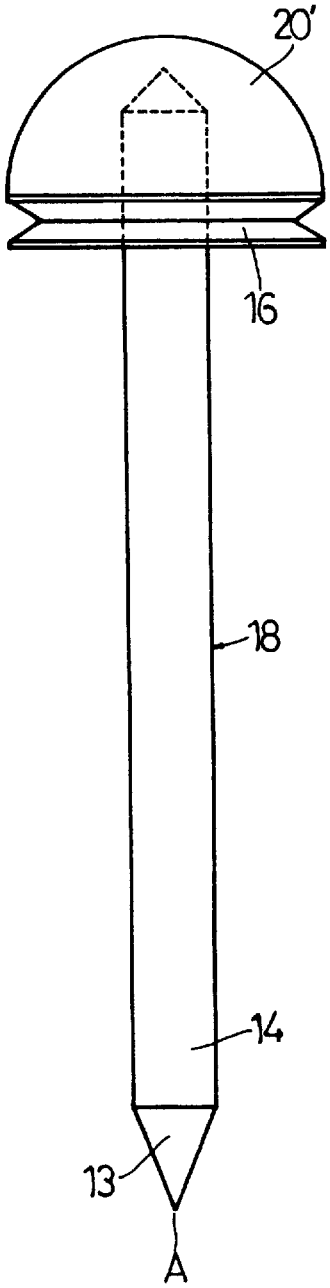
Figure 6C:
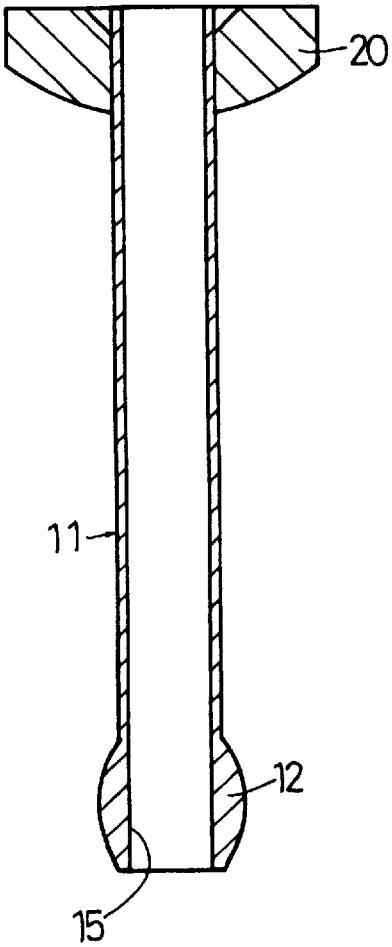

The example in FIGS. 6(*a*) to (*c*) shows a case in which the ornament 20' that is separate from the shaft 11 is fixed to the other end of the pipe-shaped shaft 11 by means of caulking. In both FIGS. 5 and 6, the shaft portion 18 and the ornament 20' are fixed together by means of caulking. In either case, the ornament 20' of the shaft 18 is pressurized by a device (gun) for penetrating the stud through the earlobe. In these two examples, the hook portion 16 is provided on the shaft portion 18. The other configuration is the same as described above, so the same reference numerals are used and its description is omitted.

Such a claspless stud 10 for piercing can be made of plastic, stainless steel, or titanium. If plastic is used as a material, the shaft 11, lock 12, and ornaments 20, 20' can be integrally formed easily, and the sharp end piece 13 can also be manufactured using an insert-molding means. Due to its availability and machinability, stainless steel is preferable for popular products. However, titanium is preferred from the perspective of metal allergy. Of course, the stud10 according to this invention can be formed by mixing a resin, metal, and special metal together.

In a process of using the stud 10 according to this invention to pierce the earlobe Y, the earlobe Y is pierced by the sharp end A to form a stub wound therein, and the hole is gradually opened by the sharp end piece 13. After the lock 12 has instantaneously passed through, the inner wall of the hole contacts the shaft 11 to form the through hole H with the same diameter as that of the shaft. This state is shown in FIG. 3(*b*). Once the through hole has been formed, the sharp end piece 13 is unnecessary, so it is detached from the shaft 11. Since the sharp end piece 13 has been removed and the stud 10 is stopped at the lock 12, the hole can be sterilized without obstruction. In addition, since the stud 10 has virtually no gap or protruding or recessed portions, bacteria cannot develop.

The ornaments 20, 20' may be arbitrarily configured. Reference numeral 21 designates a jewel and 22 is the portion in which the jewel is fitted. Of course, the present stud may be removed and replaced with a different one.

THE EFFECT OF THE INVENTION

Due to the above configuration and operation of this invention, the sharp end piece is used only for piercing and can be detached from the shaft following penetration through the earlobe. This prevents the sharp end from penetrating the skin before the stud is replaced with one without a needle, and also eliminates the need for a fixture such as a clasp, thereby enabling sterilization of the hole and cleaning of its periphery to be performed easily before the through hole has been made. The present stud can be used with all conventional piercing devices (guns).

What is claimed is:

1. A claspless stud for piercing that is worn by penetrating through an earlobe a shaft having a sharp point at one end and an ornament at the other end, wherein a lock that is larger than the diameter of the shaft is formed at one end of a shaft, and wherein a sharp end piece that is penetrated into the earlobe to form a through hole therein is formed at the tip of the lock so that it can be detached from the shaft.

2. A claspless stud for piercing according to claim 1 wherein the sharp end piece is provided at one end of the shaft by a detachable fitting means.

3. A claspless stud for piercing according to claim 2 wherein the fitting means comprises a protruding portion and a recessed portion that is detachably fitted to the protruding portion.

4. A claspless stud for piercing according to claim 1 wherein the lock has an external shape consisting of a generally spherical surface and wherein the sharp end piece has a generally conical external shape.

5. A claspless stud for piercing according to claim 1 wherein the sharp end piece has a hook portion that can be easily grasped by fingernails to detach the piece.

6. A claspless stud for piercing according to claim 1 wherein the lock prevents the shaft from slipping out of the formed through hole and is sized and shaped so as to pass through the completed through hole while widening it.

7. A claspless stud for piercing according to claim 1 wherein the shaft has a pipe-shaped structure, wherein a shaft portion is inserted into the pipe for integration, and wherein a sharp end piece is provided at the end of the shaft portion protruding from one end of the shaft.

8. A claspless stud for piercing according to claim 7 wherein the shaft having a pipe-shaped structure has at one end a lock having a diameter larger than the outer diameter of the shaft, and also has an ornament at the other end.

9. A claspless stud for piercing according to claim 7 wherein the shaft is integral and generally formed by means of machining.

10. A claspless stud for piercing according to claim 7 wherein the shaft is configured so as to have a separate ornament fixed to the other end.

* * * * *